US005395000A

United States Patent [19]

Porter

[11] Patent Number: 5,395,000

[45] Date of Patent: Mar. 7, 1995

[54] LIQUID CONTAINER WITH RESEATABLE STOPPER

[76] Inventor: Billy J. Porter, 5536 Cedar Point Dr., Crown Point, Ind. 46307

[21] Appl. No.: 94,247

[22] Filed: Jul. 19, 1993

[51] Int. Cl.[6] ..... B65D 39/16; B65D 47/20

[52] U.S. Cl. ..... 215/267; 215/31; 215/264; 215/355; 220/233; 220/262; 222/509; 222/510

[58] Field of Search ..... 215/31, 264, 265, 266, 215/267, 355; 220/233, 262, 281; 222/509, 510

[56] References Cited

U.S. PATENT DOCUMENTS

| | | | |
|---|---|---|---|
| 435,912 | 9/1890 | Bayles | 222/510 |
| 2,881,962 | 4/1959 | Hausen | 222/510 X |
| 3,902,477 | 9/1975 | Gerarde | 215/355 X |
| 4,082,163 | 4/1978 | Takeishi | 222/510 X |
| 4,286,737 | 9/1981 | Gallant | 222/510 X |
| 4,513,883 | 4/1985 | Melzi et al. | 222/510 X |
| 4,938,390 | 7/1990 | Markva | 222/206 |
| 4,973,183 | 11/1990 | Shevick et al. | 222/510 X |
| 5,123,570 | 6/1992 | Dubow et al. | 222/510 X |
| 5,150,802 | 9/1992 | Jeffers | 215/235 |
| 5,193,719 | 3/1993 | Huffman et al. | 222/153 |

FOREIGN PATENT DOCUMENTS

| | | | |
|---|---|---|---|
| 601300 | 5/1948 | United Kingdom | 222/510 |
| 1409414 | 10/1975 | United Kingdom | 222/510 |

*Primary Examiner*—Allan N. Shoap
*Assistant Examiner*—Vanessa Caretto
*Attorney, Agent, or Firm*—Kajane McManus

[57] ABSTRACT

The fluid container with reseatable stopper includes a plunger which has mounted at one end thereof a head which seats between a pair of ribs provided in the neck of the container to create a fluid tight seal therein. The plunger is actuated by a lever set in a cavity in a bottom surface of the container, the lever moving the plunger head into and out of engagement with the ribs. A small open area is created about the circumference of the plunger head which allows fluid to flow therearound in a controlled manner when the head is not seated between the ribs.

9 Claims, 1 Drawing Sheet

LIQUID CONTAINER WITH RESEATABLE STOPPER

BACKGROUND OF THE INVENTION

1. Field of the Invention

The liquid container with reseatable stopper is proposed for containing liquids therein, the containers being of the type which require inversion or significant tipping to dispense the liquid into a small space, such as motor oil, windshield washer fluid, etc. The container includes a stopper in a neck area thereof which is movable into and out of a fluid tight seat for same in the container neck.

2. Description of the Prior Art

Heretofore, various liquid containers have been proposed for use in areas where the container must be inverted completely to keep the liquid from spilling onto areas surrounding the opening into which the liquid must be poured.

For example, the Dubow et al U.S. Pat. No. 5,123,570 discloses a container for inverted dispensing which includes a frangible seal over the bottle opening and a plunger with a cutting head seated within the container to pierce the seal upon manual actuation of the plunger.

Further the Huffman et al U.S. Pat. No. 5,193,719 discloses an oil container having a valved, controlled outlet which, in one embodiment is recloseable by means of a rotatable thumb tab which activates a rotatable valve member within the neck of the bottle.

As will be described in greater detail hereinafter, the container with reseatable stopper of the present invention provides a plunger member which creates a fluid tight seal in the neck of the container, is engaged to actuating structure which also maintain the plunger within the container, with the actuating structure being lockable in one position to maintain the container neck open and in a second position to maintain the container neck closed.

SUMMARY OF THE INVENTION

According to the invention there is provided a fluid container with a reseatable stopper, the stopper comprising a plunger having a head at one end thereof which is engageable between a pair of ribs extending inwardly from an inner surface of a neck of the container and having another end thereof extending outwardly of a bottom surface of the container, the plunger being actuable to move the head thereof into and out of engagement with the ribs.

DESCRIPTION OF THE PREFERRED EMBODIMENT

Figure 1:
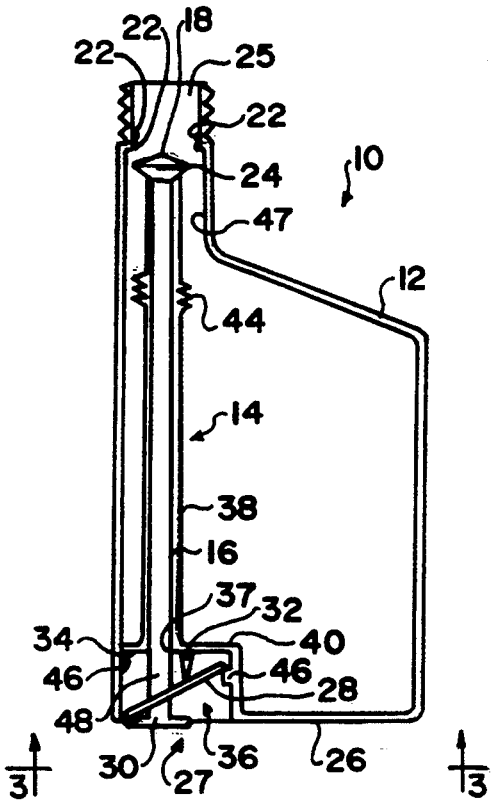
FIG. 1 is a cross sectional view through a liquid container incorporating the reseatable stopper of the present invention, showing same unseated.
Figure 2:
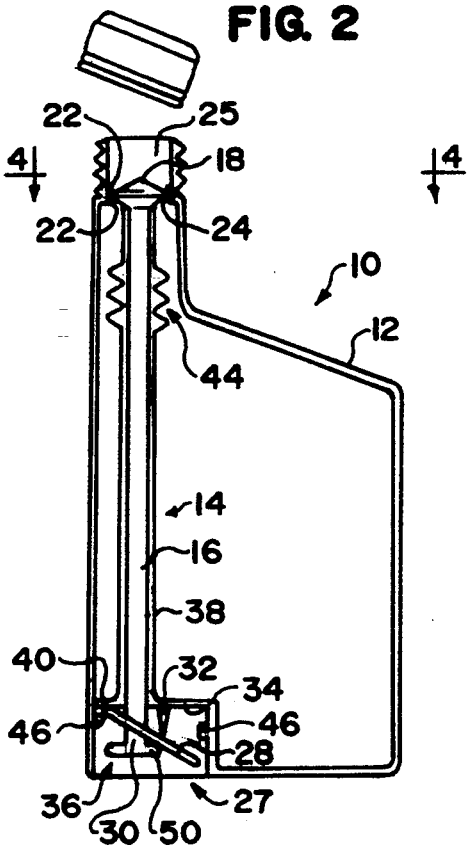
FIG. 2 is similar to FIG. 1 but shows the stopper seated.
Figure 3:
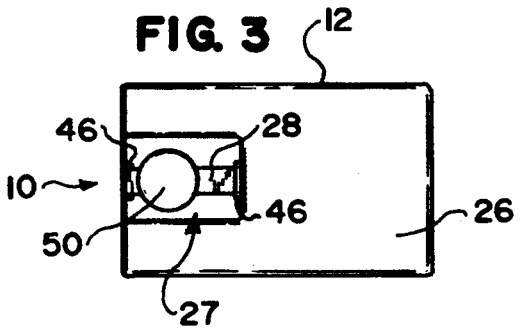
FIG. 3 is a bottom view of the container showing the actuator for the stopper.
Figure 4:
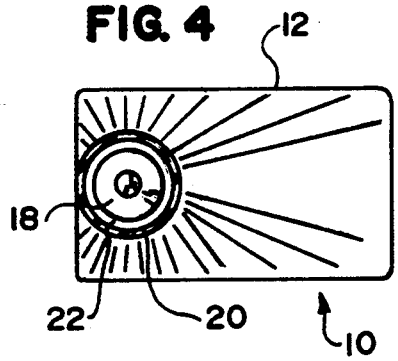
FIG. 4 is a top view of the container showing the stopper seated in the container neck.

Referring now to the drawings in greater detail there is illustrated therein the fluid container with reseatable stopper made in accordance with the teachings of the present invention and generally identified by the reference numeral 10.

As shown in the illustrated embodiment, the container 12 may be of the type used in storing engine oil, power steering fluid, windshield washing fluid, or the like, where the fluid must be poured through a small opening or port, requiring near or total inversion of the container 12.

In all instances, it is preferable not to spill any liquid on engine parts, and in some instances, such as when using less than an entire container of fluid, it is preferable to be able to selectively reseal the container 12 before it is entirely empty, again avoiding spillage.

To this end, the container 12 is provided with a selectively actuatable stopper assembly generally identified by reference numeral 14.

As shown, the stopper assembly 14 includes a plunger 16 having a head 18 which has a diameter slightly less than that of the interior diameter of the neck 20 of the container 12.

To create a fluid tight seal within the neck 20, a pair of inwardly extending circumferential ribs 22 are provided on an inner wall 47 of the container neck 20. Such ribs 22 are so spaced from one another as to receive securely therebetween a circumferential end edge 24 of the plunger head 18, in a snap fit manner. Once the plunger head 18 is so engaged between the ribs 22, fluid cannot pass beyond this point, eliminating leakage toward the container opening 25.

The plunger 16 must be operable from a position outside the container 12 and preferably from the bottom surface 26 of the container 12 since the bottom surface 26 becomes easily accessible upon inversion of the container 12.

For this reason, an actuating assembly 27 is engaged within a recess 36 provided in the bottom surface 26 of the container 12.

The actuating assembly 27 includes a lever arm 28 to one end of which is engaged an end 30 of the plunger 16, the lever arm 28 being movable about a pivot 32 substantially centered therebeneath, which pivot 32 is fixed to a bottom wall 34 of the recess 36.

Upon pivoting of the lever arm 28, a sliding motion of the plunger 16 is produced which in turn causes engagement or disengagement of the head 18 thereof with the ribs 22.

To create an engagement between the plunger 16 and the lever 28, it is obvious that the plunger 16 must extend through an opening 37 in the bottom wall 34 of the cavity 36.

In order to provide a leak free container 12, it is proposed to engage a sleeve 38 about the plunger 16 extending from the head 18 thereof to an inner surface 40 of the bottom wall 34 of the cavity 36 to isolate the opening 37 for the plunger 16 from the fluid in the container 12.

To assure that this sleeve 38 does not interfere with actuation of the plunger 16, a portion 44 thereof may be accordion pleated to allow for shortening of the sleeve 38 when the plunger head 18 is moved out of engagement with the ribs 22.

Returning to a study of the plunger head 18 for a moment, it is understood that only a small gap exists about the periphery thereof, between the circumferential end edge 24 thereof and the inner wall 47 of the container neck 20. Such gap is necessarily small to provide a controllable flow of fluid from the container 12 with the level of fluid being easily observed in known manner, such as by creating a window area of translucent or transparent material along one side of the container 12 or by making the entire container 12 of such a material.

As stated above, the plunger head 18 is reseatable within the area between the ribs 22 when a desired amount of fluid has been dispensed from the container 12.

In this respect, the lever arm 28 is capable of being pivoted back to a position which causes depression of the plunger 16, reseating the head 18 at the other end thereof between the ribs 22.

To assure that the plunger 16 is maintained in the fully open or fully closed positions thereof, a stop member 46 is provided at an appropriate position within the cavity 36 relative to each end of the lever arm 28, the lever arm 28 end snapping beneath the stop member 46 and being held therebelow until pivoted manually to the opposite position thereof.

To keep the plunger 16 engaged appropriately within the container 12, it is provided with an enlarged nub 50 on the end 48 thereof which keeps the plunger 16 end from escaping entrapment within an opening (not shown) for same in the lever arm 28.

As described above, the fluid container with reseatable stopper 10 of the present invention provides a number of advantages, some of which have been described above and others of which are inherent in the invention. Also modifications may be proposed without departing from the teachings herein. Accordingly, the scope of the invention is only to be limited as necessitated by the accompanying claims.

I claim:

1. A fluid container with a reseatable stopper, the stopper comprising a plunger having a head at one end thereof which is engageable between a pair of ribs extending inwardly from an inner wall of a neck of the container and having another end thereof extending outwardly of a bottom surface of the container, the plunger being actuable to move the head thereof into and out of engagement with the ribs, said plunger end extending outwardly of said container bottom surface engaging one end of a lever arm seated in a cavity in said bottom surface, the lever being pivotable about a pivot at a near centerpoint thereof to cause movement of the plunger.

2. The container of claim 1 wherein said plunger extends through an opening in a bottom wall of said cavity.

3. The container of claim 2 wherein said plunger has a sleeve therearound, one end of which engages the plunger head and another end of which engages said cavity bottom wall, surrounding the opening therein.

4. The container of claim 3 wherein said lever has two ends.

5. The container of claim 4 wherein each end of said lever is engaged under a stop member for same when said end is positioned proximate said cavity bottom wall.

6. The container of claim 5 wherein said sleeve has an accordion pleated portion.

7. The container of claim 6 wherein said lever arm is pivotable about a pivot member extending into the cavity from the bottom wall of the cavity.

8. The container of claim 7 wherein said plunger extends through an opening in one end of said lever.

9. The container of claim 8 wherein said plunger has an increased in diameter nub at the end thereof extending outwardly of said container bottom surface to maintain engagement with an opening in said lever.

* * * * *